United States Patent [19]

Cunningham

[11] 4,301,576

[45] Nov. 24, 1981

[54] TONGUE AND BUCKLE FASTENER FOR A SAFETY BELT HARNESS

[75] Inventor: Douglas J. Cunningham, Lutterworth, England

[73] Assignee: Britax (Wingard) Limited, Chichester, England

[21] Appl. No.: 169,243

[22] Filed: Jul. 16, 1980

[30] Foreign Application Priority Data

Jul. 18, 1979 [GB] United Kingdom ..... 24952/79

[51] Int. Cl.[3] ..... A44B 11/26

[52] U.S. Cl. ..... 24/230 AL; 24/230 AT

[58] Field of Search ..... 24/230 R, 230 A, 230 AK, 24/230 AL, 230 AT

[56] References Cited

U.S. PATENT DOCUMENTS

| | | | |
|---|---|---|---|
| 3,170,211 | 2/1965 | Van Noord | 24/230 A |
| 3,349,445 | 10/1967 | Foster et al. | 24/230 A |
| 3,522,640 | 8/1970 | Lohr | 24/230 AL |
| 3,656,211 | 4/1972 | Turner et al. | 24/230 AL |
| 3,763,523 | 10/1973 | Lindblad | 24/230 AL |
| 3,789,492 | 2/1974 | Klink | 24/230 AL |
| 4,064,603 | 12/1977 | Romanzi, Jr. | 24/230 A |
| 4,096,606 | 6/1978 | Stephenson | 24/230 A |
| 4,136,425 | 1/1979 | Esner | 24/230 A |
| 4,197,619 | 4/1980 | Burleigh | 24/230 AL |

*Primary Examiner*—Victor N. Sakran

*Attorney, Agent, or Firm*—Strimbeck, Davis & Soloway

[57] ABSTRACT

A tongue and buckle fastener for a safety belt harness has a tongue 1 with a radiused head portion 3 shaped to mate with a recess 8 in an ejector 17. A latch plate 20 moves at right angles to the direction of insertion of the tongue 1 to engage behind the head portion 3 of the tongue 1. When the tongue 1 has been ejected, the latch plate 20 engages in a groove 28 in one side face of the ejector 17 and overhangs the recess 18 in the ejector 17. When the tongue 1 is inserted, it engages corners 29*a* and 29*b* on the latch plate 20 which overhang the recess 18 so as to lift the latch plate 20 out of the groove 28. If a member of any other shape than the tongue 1 is inserted, it cannot engage with both corners 29*a* and 29*b* simultaneously. Consequently only one side of the latch plate 20 is lifted and the ejector continues to block further insertion of such a member.

3 Claims, 5 Drawing Figures

TONGUE AND BUCKLE FASTENER FOR A SAFETY BELT HARNESS

This invention relates to a tongue and buckle fastener for a safety belt harness of the type in which the buckle includes a spring-loaded latching member, which moves transversely of the direction of tongue insertion, and a spring-loaded tongue ejector.

Our copending Application No. 7900356 discloses a tongue and buckle fastener in which, after the tongue has been ejected, the latching member is retained in its released position by the ejector. Consequently, although the spring biasing the latching member is sufficiently strong to ensure reliable latching when the tongue is inserted, it does not contribute significantly to the forces opposing insertion of the tongue. This arrangement suffers from the disadvantage that if, in the course of tampering with the buckle, the ejector is depressed for example with a screwdriver, the latching member moves into its latched position in which it blocks subsequent attempts to insert the tongue. The present invention aims to avoid this disadvantage.

According to the invention, a tongue and buckle fastener for a safety belt harness comprises a tongue having a head portion, a buckle having a passageway for receiving the tongue, a spring-loaded latching member which is movable transversely of the passageway between a latching position and a release position, and a spring-loaded tongue ejector which is slidable in the passageway, the ejector having a recess shaped to engage with the head of the tongue and disposed so that, when the tongue has been ejected, the latching member rests on a side face of the ejector with a corner overhanging the recess, said side face of the ejector having an abutment adjacent to said corner of the latching member which engages with the latching member to inhibit inward movement of the ejector, the head of the tongue being operative, when inserted into the recess in the ejector, to engage with said overhanging corner of the latching member, thereby to lift the latching member clear of said abutment and allow inward movement of the ejector.

Preferably the latching plate has two corners overhanging opposite sides of the recess in the ejector and the side face thereof has two abutments, each adjacent to a respective corner. If the latching member is allowed a limited amount of tilting movement, it cannot be lifted clear of the abutments, except by simultaneous engagement with both projecting corners. It is difficult to achieve such simultaneous engagement except with the tongue itself, thereby further enhancing the buckle's resistance to tampering.

The abutments on one side face of the ejector may conveniently take the form of one wall of a groove in said side face.

An embodiment of the invention will now be described by way of example with reference to the accompanying drawings, in which.

The drawings show a tongue 1 and a buckle 2, similar to those illustrated in our co-pending Application No. 7900356. The tongue 1 has a head portion 3 with a pair of latching shoulders 3*a* and 3*b*. The head portion 3 is radiused to provide a nose for engaging a similarly radiused recess in an ejector member described below.

Figure 3:
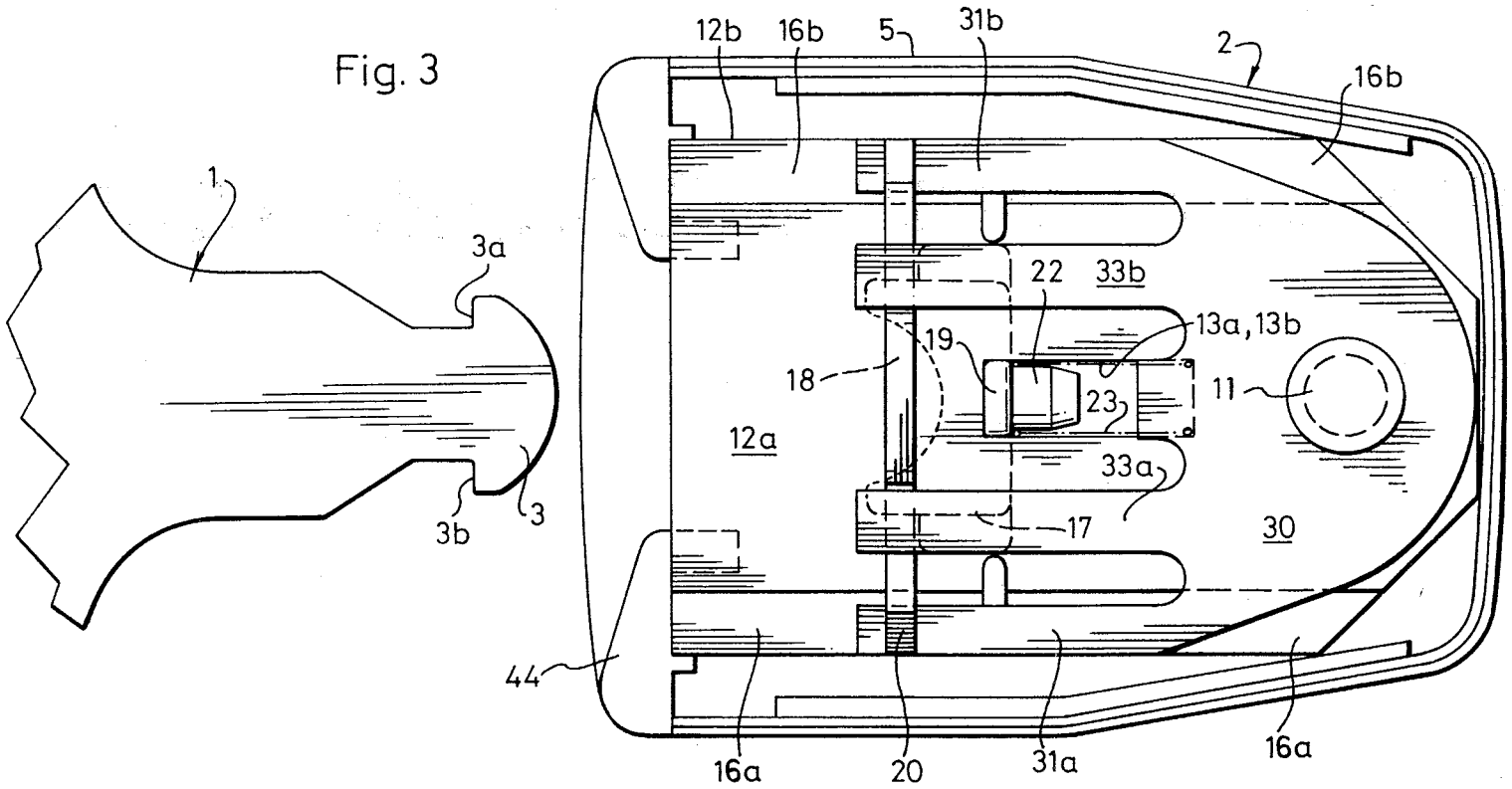
FIG. 3 is a plan view, of the mechanism of FIG. 1 with the upper casing removed and with the tongue ejected.
Figure 4:
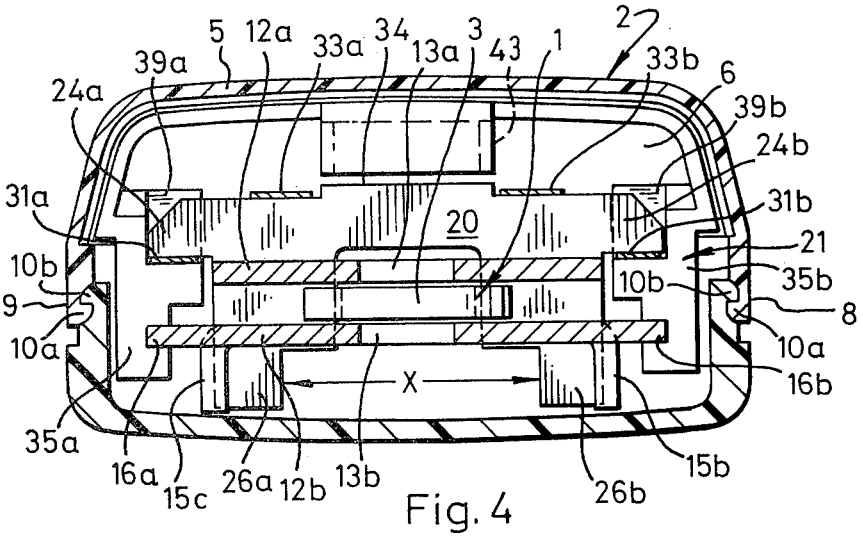
FIGS. 4 and 5 are transverse sections on lines IV—IV, V—V respectively of the buckle shown in FIGS. 1 and 2.
Figure 5:
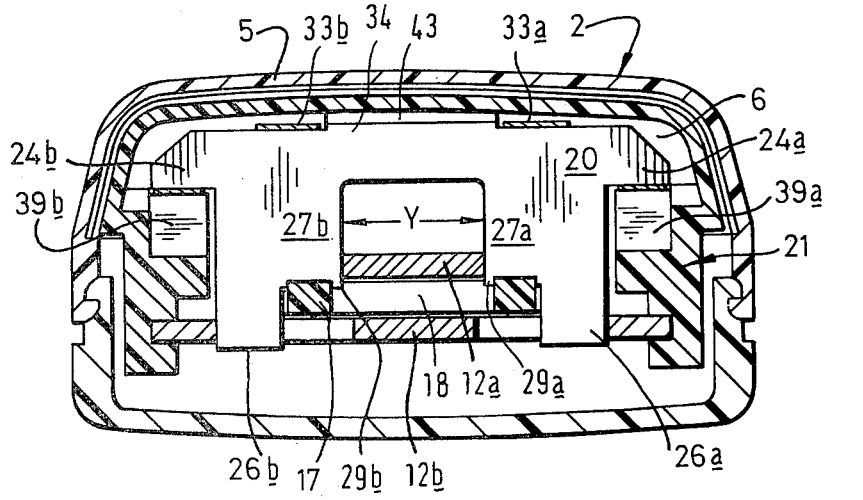

The buckle 2 comprises a housing 5 in which a push button 6 is slidably mounted for movement in the direction of the arrow 7. As seen in FIG. 4, the housing 5 is of a two-part construction which is secured along both sides by interengaging hooked portions 10*a*, 10*b*. The housing 5 contains a pair of frame members 12*a* 12*b* which are secured together with an intermediate mounting bracket portion 13 by a rivet 11. The frame members 12*a*, 12*b* are in the form of plates with cutouts 13*a*, 13*b*. The distance W (FIG. 2) between the plates 12*a*, 12*b* is slightly greater than the thickness of the tongue 1. The plates 12*a*, 12*b* therefore form a passageway 14 into which the tongue 1 can be inserted. As seen in FIGS. 4 and 5, the lower plate 12*b* has turned down portions 15*b*, 15*c* which serve to protect the lower end of the latching member 20 from any crushing loads which may be applied to the buckle in service. Plate 12*b* also has laterally extending portions 16*a*, 16*b* (FIGS. 3 and 4) which serve as guides for a camming member 21, as will be explained hereinafter.

An ejector 17 has a radiused recess 18 for engaging the radiused edge of the head portion 3 of the tongue 1. The rear portion of the ejector 17 is formed by a rectangular section portion 19, which projects into the respective cutouts 13*a* and 13*b* of plates 12*a*, 12*b*. This serves to guide the ejector 17 longitudinally of the passageway 14 when the tongue is inserted. A circular section portion 22 with a chamfered edge serves to locate one end of a coil spring 23, the other end of which engages the ends of the cutouts 13*a* and 13*b*.

A latching member 20 is in the form of a bridge having a pair of oppositely directed lateral shoulders 24*a*, 24*b*. The bridge 20 is also provided with a pair of downwardly directed feet 26*a* 26*b*, the distance X therebetween (FIG. 4) being slightly larger than the breadth of the head portion 2 of the tongue 1. A pair of inwardly directed shoulders 27*a*, 27*b* adjoin the respective feet 26*a*, 26*b*. The distance Y (FIG. 5) between the shoulder 27*a*, 27*b* enables the radiused end of the head portion 2 of the tongue 1 to engage with the radiused recess 18 of the ejector 17. However, when the bridge 20 is in its latching position, the shoulders 27*a*, 27*b* serve to engage the respective latching shoulders 3*a*, 3*b* of the tongue 1 when fully inserted into the buckle.

Figure 2:
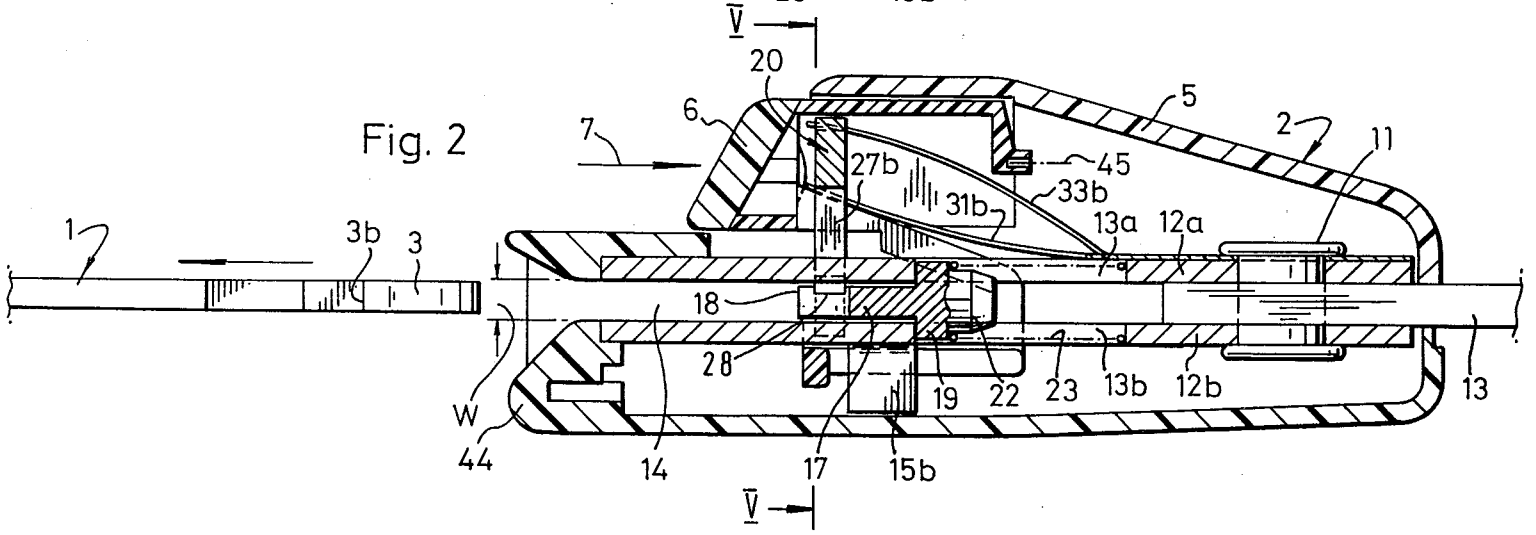

In accordance with the present invention, the ejector 17 has a groove 28 in the surface thereof facing the frame member 12*a*, as can be seen in FIGS. 2 and 5. When the bridge 20 is in its released position, the ends of the shoulders 27*a* and 27*b* engage in groove 28 with their corners 29*a* and 29*b* projecting slightly into the recess 18.

Figure 1:
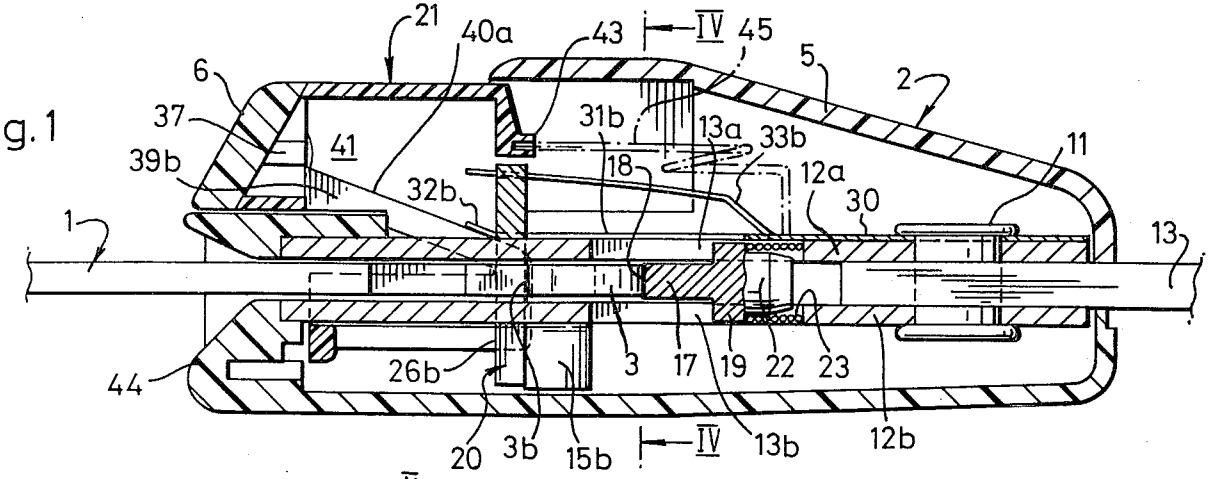
FIGS. 1 and 2 are sectional elevations of a buckle with the tongue inserted and ejected respectively.

A spring member 30 is in the form of a flat plate with an aperture to receive the rivet 11 which secures it to the upper frame member 12*a*. It also has a pair of outer arms 31*a*, 31*b*, which are positioned so as to extend beneath the shoulders 24*a*, 24*b* of the bridge 20 and to terminate in turned-up ends, only one of which, namely 32*b*, is seen in FIG. 1. A pair of inner arms 33*a*, 33*b*, which serve as leaf springs, rest on the top of the bridge 20, one on each side of a protuberance 34. The springs 33*a*, 33*b* provide a downward bias on the bridge 20 which acts substantially perpendicularly of the direction of insertion of the tongue 1 into the buckle.

The camming member 21 is secured by a rivet 37 to the push button 6. The camming member extends over the upper plate 12*a*, adjacent the roof of housing 5 and downwardly, at each side, as shown in FIG. 4. The sides 35*a*, 35*b* are provided with grooves which are slidably located on the guides provided by the laterally extending portions 16*a*, 16*b* respectively of the lower plate 12*b*. This enables the push button 6 and camming member 21 to be slidably guided in the direction of insertion of the tongue 1. The camming member 21 has a pair of ramps 39*a*, 39*b* which form camming surfaces (see 40*a* of FIG. 1). On depressing the push button 6, the camming member 21 moves toward the bridge 20 and the camming surfaces 40*a* raise the bridge 20 into a recess 41. This movement also loads the inner leaf springs 33*a*, 33*b* which bear down on the bridge 20. It will also be noted from FIGS. 1 to 4, that the ends of the arms 31, 31*b* pass beneath the shoulders 24*a*, 24*b* of the bridge 20 and rest on the camming surfaces 40*a*, 40*b*. This avoids friction between the camming member 21 and the bridge 20 which would otherwise lead to wear of the camming surfaces, if, as is convenient, camming member is made of plastics and latching member is made of steel.

A return spring 45 is located in the housing so as to engage part 43 of the camming member 21 and to serve as a return spring for the push button and member 21.

The entrance of passageway 14 is bounded by a mouth-piece 44 which also serves to locate the ends of plates 12*a*. 12*b*. At the other end of the buckle, the housing 5 is apertured so as to receive the mounting bracket portion 13.

In operation, the tongue 1 is inserted into the passageway 14 with the buckle 2 in the state shown in FIG. 2 (FIG. 2 also illustrates the ejection of tongue 1 by depressing the push button 6 in the direction of the arrow). The latching bridge 20 is in a raised position, almost but not quite clear of the path of the tongue 1, because the shoulders 27*a*, 27*b* rest in the groove 28 in the upper, forwardly extending surface of the ejector 17. Initially, the head portion of the tongue 1 engages with the corners 29*a*, 29*b* on the bridge 20 but, because these corners and the edges of the tongue 1 are radiused, the effect of continued insertion of the tongue is to lift the bridge 20 out of the groove 28 so that it rests on the ejector 17 and the head portion 2 of the tongue 1 engages the recessed portion 18 of the ejector 17 and the ejector begins to move rearwardly against the bias of spring 23. On further insertion, the head portion of the tongue passes beneath the lower edges of shoulders 27*a*, 27*b* and the bridge 20 is urged downwardly, by the leaf springs 33*a*, 33*b*, into its latching position as shown in FIGS. 1 and 4. Spring 23 has been compressed and is ready to eject the tongue when bridge 20 is next raised.

As shown in FIG. 2, depression of the push button 6 to move the camming member 21 rearwardly results in the movement of bridge 20 into its raised position due to the ramps 39*a*, 39*b* sliding under the spring arms 31*a*, 31*b* and beneath the shoulders 24*a*, 24*b* of the bridge 20. The spring arms 31*a*, 31*b* and 33*a*, 33*b*, are thus deflected and tensioned as shown in FIG. 2. As soon as the latching shoulders 27*a*, 27*b* are clear of the edges of the latching shoulders 3*a*, 3*b* of the tongue 1, the tongue is ejected by the spring 23. As the tongue slides beneath the shoulders 27*a*, 27*b*, the ejector 17 follows in order to maintain the bridge 20 in its raised position until it is received in the groove 18, in preparation for the next insertion of the tongue.

Because of the groove 28, rearward movement of the ejector 17 can only be initiated by an object which engages with both corners 29*a* and 29*b* simultaneously. If an attempt is made to depress the ejector 17 with an object, such as a screwdriver, which engages with only corner 29*a*, 29*b*, the bridge 20 will tilt leaving the shoulder 27*b*, 27*a* carrying the other corner in engagement with the groove 28.

I claim:

1. A tongue and buckle fastener for a safety belt harness comprises a tongue having a head portion, a buckle having a passageway for receiving the tongue, a spring-loaded latching member which is movable transversely of the passageway between a latching position and a release position, and a spring-loaded tongue ejector which is slidable in the passageway, the ejector having a recess shaped to engage with the head of the tongue and disposed so that, when the tongue has been ejected, the latching member rests on a side face of the ejector with a corner overhanging the recess, said side face of the ejector having an abutment adjacent to said corner of the latching member which engages with the latching member to inhibit inward movement of the ejector, the head of the tongue being operative, when inserted into the recess in the ejector, to engage with said overhanging corner of the latching member, thereby to lift the latching member clear of said abutment and allow inward movement of the ejector.

2. A tongue and buckle fastener according to claim 1, wherein the latching member has two corners overhanging opposite sides of the recess in the ejector and the side face of the ejector has two abutments, each adjacent to a respective corner.

3. A tongue and buckle fastener according to claim 2, wherein the abutments on the side face of the ejector plate are provided by forming a groove in said face positioned so that the latching member is received in the groove after the tongue has been ejected.

* * * * *